US011609513B2

(12) United States Patent
Takahashi

(10) Patent No.: US 11,609,513 B2
(45) Date of Patent: Mar. 21, 2023

(54) BELT DRIVING DEVICE, BELT DRIVING METHOD, AND IMAGE FORMING APPARATUS

(71) Applicant: Motoharu Takahashi, Kanagawa (JP)

(72) Inventor: Motoharu Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/718,374

(22) Filed: Apr. 12, 2022

(65) Prior Publication Data

US 2022/0334519 A1 Oct. 20, 2022

(30) Foreign Application Priority Data

Apr. 15, 2021 (JP) ..... JP2021-069214

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1605; G03G 15/1615
USPC ..... 399/36, 165, 302
See application file for complete search history.

(56) References Cited

U.S. PATENT DOCUMENTS 8,406,665 B2 * 3/2013 Hirose et al. ..... G03G 15/0131 399/302
2013/0161900 A1 6/2013 Takahashi et al.
2017/0001822 A1 1/2017 Asano et al.
2017/0090386 A1 3/2017 Takahashi et al.
2017/0187321 A1 6/2017 Nagatsuka et al.
2018/0093841 A1 4/2018 Momose et al.
2019/0161299 A1 5/2019 Egawa et al.
2019/0161301 A1 5/2019 Maeyama et al.
2019/0241385 A1 8/2019 Kaneko et al.
2019/0276258 A1 9/2019 Egawa et al.
2019/0283998 A1 9/2019 Uchida et al.

FOREIGN PATENT DOCUMENTS

JP 3-288167 12/1991
JP 11-295948 10/1999
JP 2003-312885 11/2003
JP 2009-251322 10/2009
JP 2012-063427 3/2012

* cited by examiner

*Primary Examiner* — William J Royer
(74) *Attorney, Agent, or Firm* — Xsensus LLP

(57) ABSTRACT

A belt driving device includes an adjustment roller to stretch and rotate an endless belt; an inclination adjuster including a cam to adjust inclination of the roller to control deviation of the belt; a belt position detector to detect a belt position in a direction orthogonal to a movement direction of the belt; a stepping motor to rotate the cam; and a control output adjuster to adjust a control output to be supplied to the motor based on the belt position. When obtaining a rotation angle less than one step of the motor, the control output adjuster supplies the control output to the motor for a time corresponding to the rotation angle less than the one step out of a supply time of the control output for obtaining a rotation angle of the one step, and stops supplying the control output for a remaining time out of the supply time.

6 Claims, 10 Drawing Sheets

BELT DRIVING DEVICE, BELT DRIVING METHOD, AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-069214, filed on Apr. 15, 2021, in the Japan Patent Office, the entire disclosure of which is hereby incorporated by reference herein.

TECHNICAL FIELD

Embodiments of the present disclosure relate to a belt driving device, a belt driving method, and an image forming apparatus.

RELATED ART

Image forming apparatuses such as copying machines or printers have been known that use an endless belt such as an intermediate transfer belt, a photoconductor belt, or a transfer conveyance belt. Due to their rotation, such an endless belt may deviate or meander in a direction orthogonal to the moving direction (rotation direction) (belt deviation phenomenon).

When such a belt deviation phenomenon of the endless belt occurs, a color image forming apparatus, for example, may cause misalignment of color toner images to generate color shift, which results in deterioration of image quality. For this reason, in a belt driving device having such endless belts, particularly, in a color image forming apparatus as described above, it is necessary to prevent deviation or meandering of the endless belt.

Therefore, for example, there has been proposed a method by which registration marks are provided at two positions on an endless belt, and the positions of the registration marks are detected by a solid-state image sensing device (CCD). At least one tension roller that stretches the endless belt is inclined to reciprocate the endless belt between the two registration marks based on the detection result.

In addition, there has been proposed a method by which to store an edge shape of an endless belt. The detection results of the edge shape and position of the endless belt are compared, and the inclination of the tension roller with the endless belt is changed in accordance with the comparison difference to control the belt deviation.

Besides, there has also been known a method by which a belt deviation controller adjusts the inclination angle of an endless belt via a stepping motor and controls the widthwise position of the endless belt to a reference position to correct the belt deviation.

SUMMARY

According to an embodiment of the present disclosure, a belt driving device includes an adjustment roller, an inclination adjuster, a belt position detector, a stepping motor, and a control output adjuster. The adjustment roller stretches and rotates an endless belt. The inclination adjuster includes a cam to adjust inclination of the adjustment roller to control deviation of the endless belt. The belt position detector detects a belt position of the endless belt in a direction orthogonal to a movement direction of the endless belt. The stepping motor rotates the cam of the inclination adjuster.

The control output adjuster adjusts a control output to be supplied to the stepping motor based on the belt position detected by the belt position detector. When obtaining a rotation angle less than one step of the stepping motor, the control output adjuster supplies the control output to the stepping motor for a time corresponding to the rotation angle less than one step of the stepping motor out of a supply time of the control output for obtaining a rotation angle of the one step of the stepping motor, and stops supplying the control output for a remaining time out of the supply time.

According to another embodiment of the present disclosure, an image forming apparatus includes the belt driving device.

According to still another embodiment of the present disclosure, a belt driving method includes: rotating an adjustment roller of a belt driving device to rotate an endless belt of the belt driving device; adjusting inclination of the adjustment roller to control deviation of the endless belt; detecting, with a belt position detector, a belt position in a direction orthogonal to a movement direction of the endless belt; rotating a cam with a stepping motor to adjust the inclination of the adjustment roller; adjusting a control output to be supplied to the stepping motor, based on the belt position detected by the belt position detector; to obtain a rotation angle less than one step of the stepping motor, supplying the control output to the stepping motor for a time corresponding to the rotation angle less than the one step of the stepping motor out of a supply time of the control output for obtaining a rotation angle of the one step of the stepping motor; and stopping supply of the control output for a remaining time out of the supply time.

BRIEF DESCRIPTIONS OF THE DRAWINGS

A more complete appreciation of the disclosure and many of the attendant advantages and features thereof can be readily obtained and understood from the following detailed description with reference to the accompanying drawings, wherein.

Figures 8A, 8B, 8C:
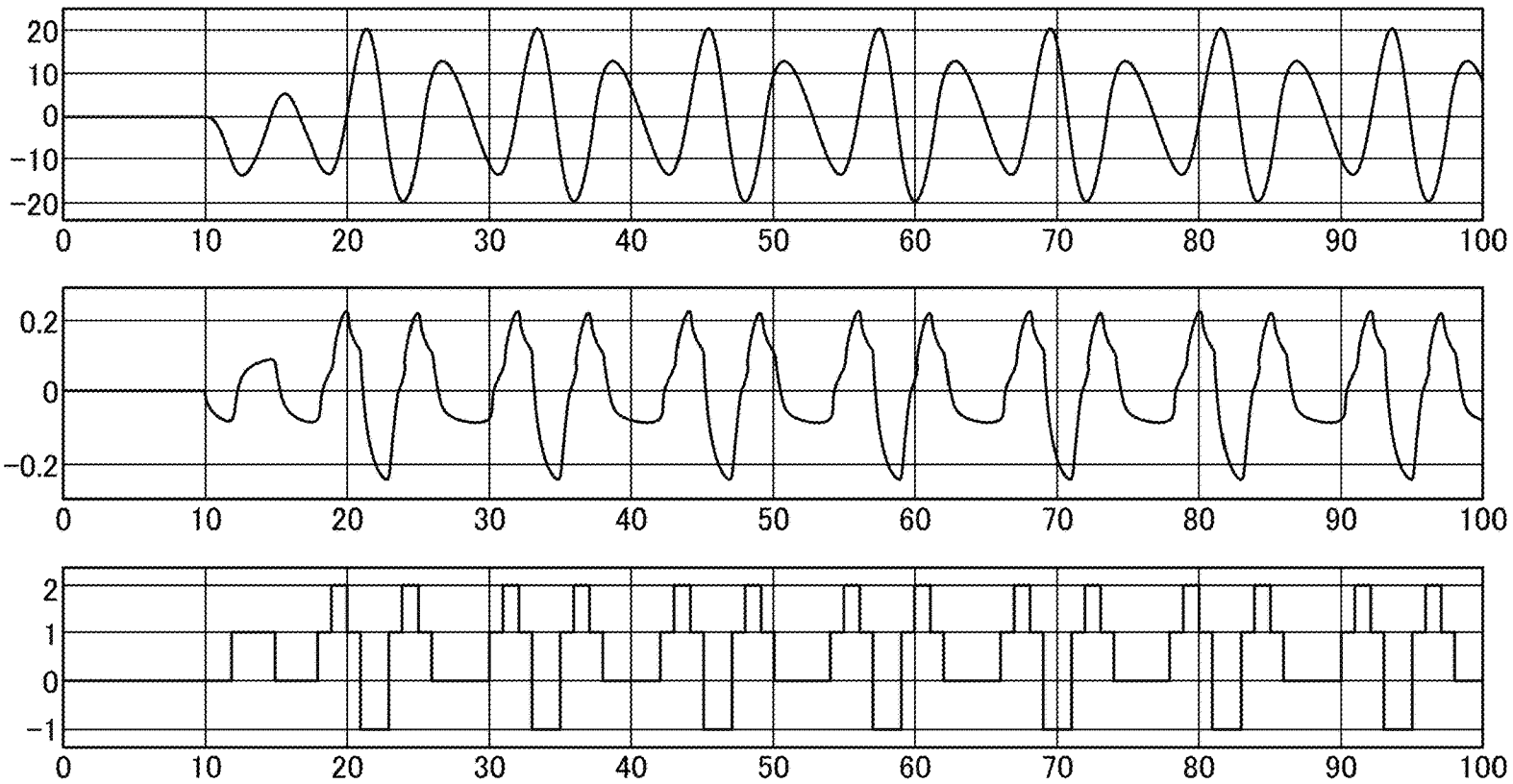
Figure 9:
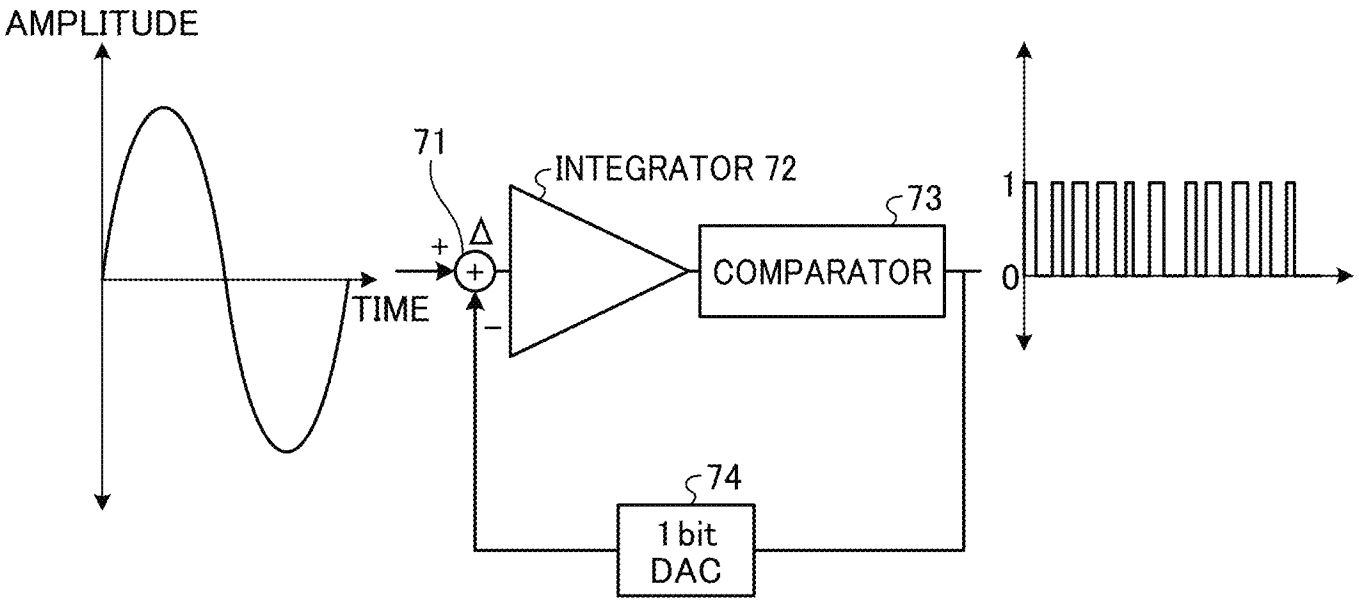
Figure 10A:
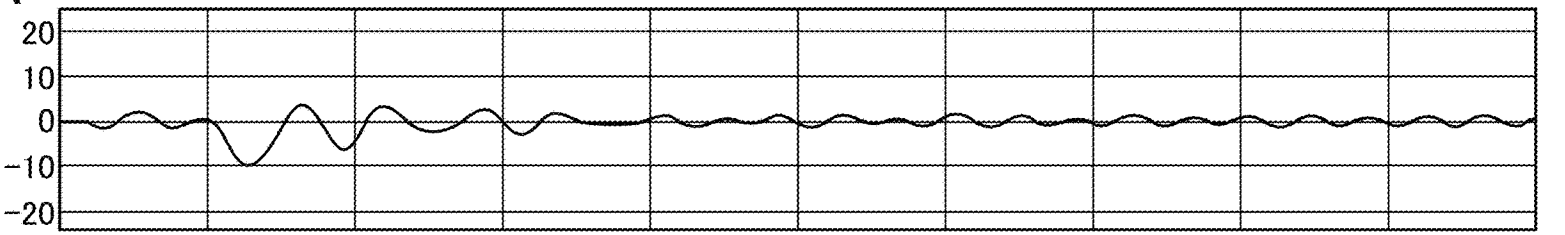
Figure 10B:
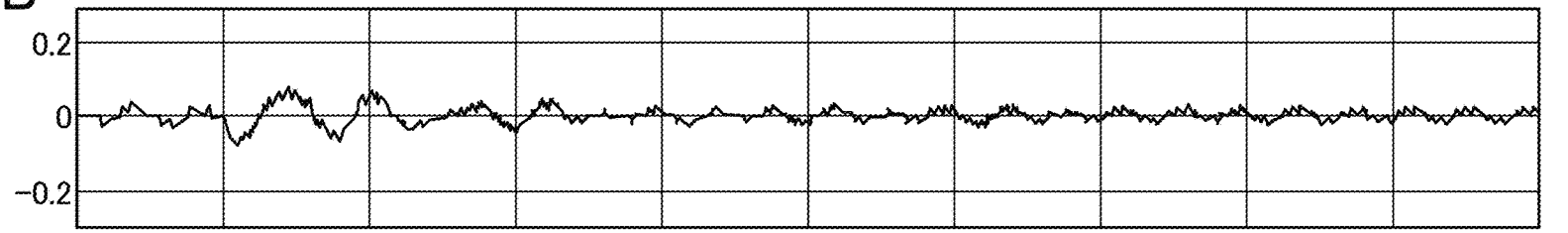
Figure 10C:
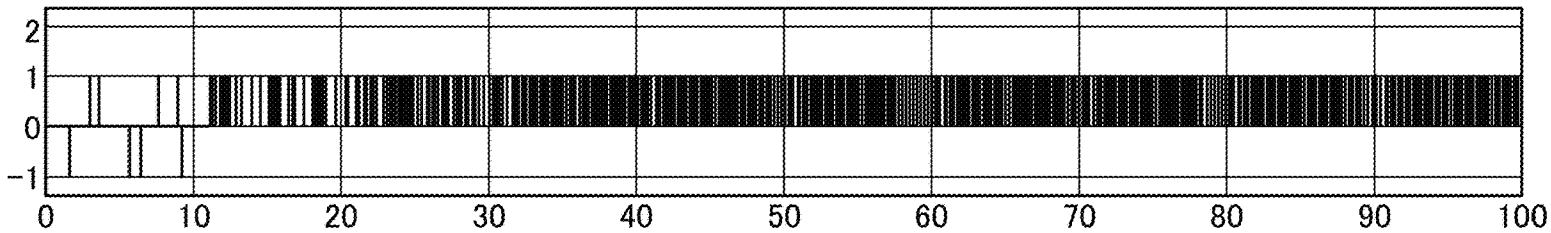
Figure 11:
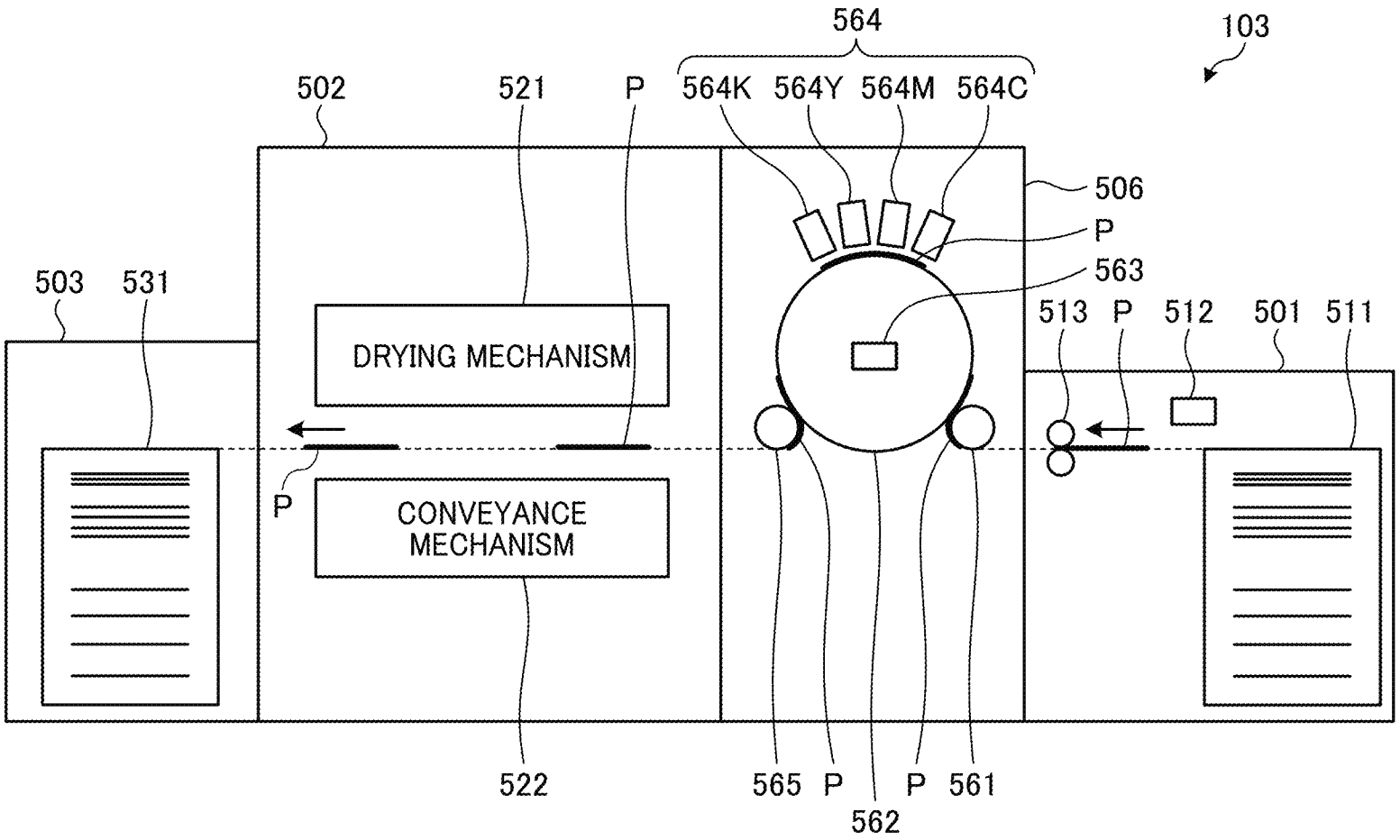

FIGS. 8A, 8B, and 8C are diagrams illustrating positional variation and deviation speed of the intermediate transfer belt and the number of control steps of a cam motor in a case where the rotation angle of the cam motor is controlled by each step;

FIG. 9 is a circuit diagram of a delta sigma modulator provided in the belt deviation controller of the image forming apparatus in the printing system of the embodiment:

FIGS. 10A, 10B, and 10C are diagrams illustrating positional variation and deviation speed of the intermediate transfer belt and the number of control steps of a cam motor in a case where the rotation angle of the cam motor is controlled by less than one step; and FIG. 11 is a diagram for describing a modification example of the printing system of the embodiment, where an inkjet image forming apparatus is provided as the image forming apparatus.

The accompanying drawings are intended to depict embodiments of the present invention and should not be interpreted to limit the scope thereof. The accompanying drawings are not to be considered as drawn to scale unless explicitly noted.

DETAILED DESCRIPTION OF EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, a printing system according to an embodiment will be described with reference to the accompanying drawings.

System Configuration

Figure 1:
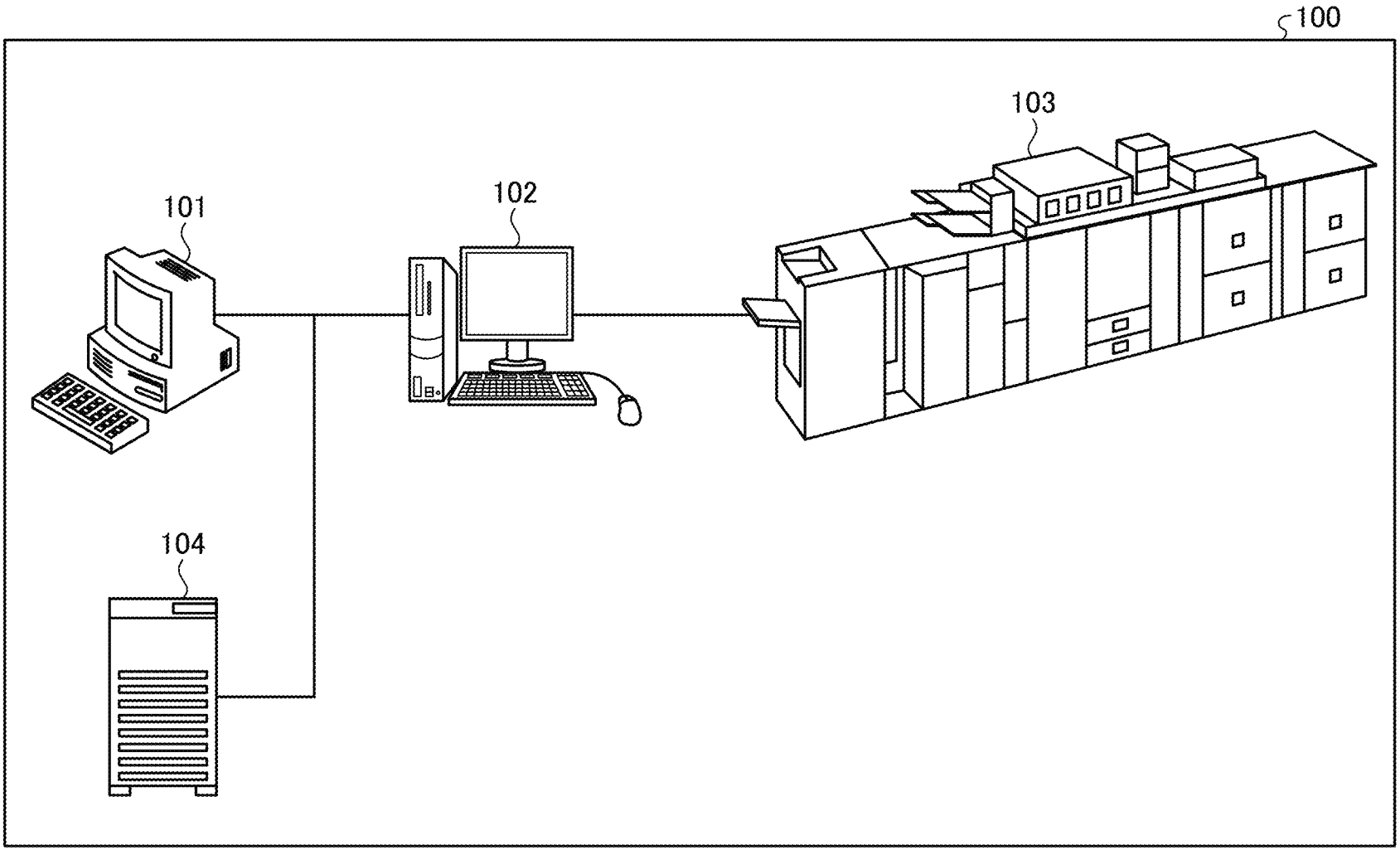
FIG. 1 is a diagram illustrating a system configuration of a printing system of an embodiment of the present disclosure.

FIG. 1 is a diagram illustrating a system configuration of a printing system 100 of a first embodiment. Referring to FIG. 1, the printing system 100 of the first embodiment includes a client personal computer device (client PC) 101, a digital front end (DFE) 102, an image forming apparatus 103, and a management server 104.

The client PC 101 includes a display unit such as a liquid crystal display and an input device such as a mouse device and a keyboard device. The client PC 101 creates a print job of an image or the like to be printed and transmits the print job to the DFE 102 or the management server 104.

The DFE 102 receives the print job from the client PC 101 or the management server 104, creates drawing data using a raster image processor (RIP) engine on the basis of the received print job, and transmits the drawing data to the image forming apparatus 103.

The image forming apparatus 103 performs an image forming operation on the basis of the drawing data received from the DFE 102.

The management server 104 manages the print job received from the client PC 101. The management server 104 also transmits the print job to the DFE 102 in response to a request from the DFE 102.

Configuration of the Image Forming Apparatus

Figure 2:
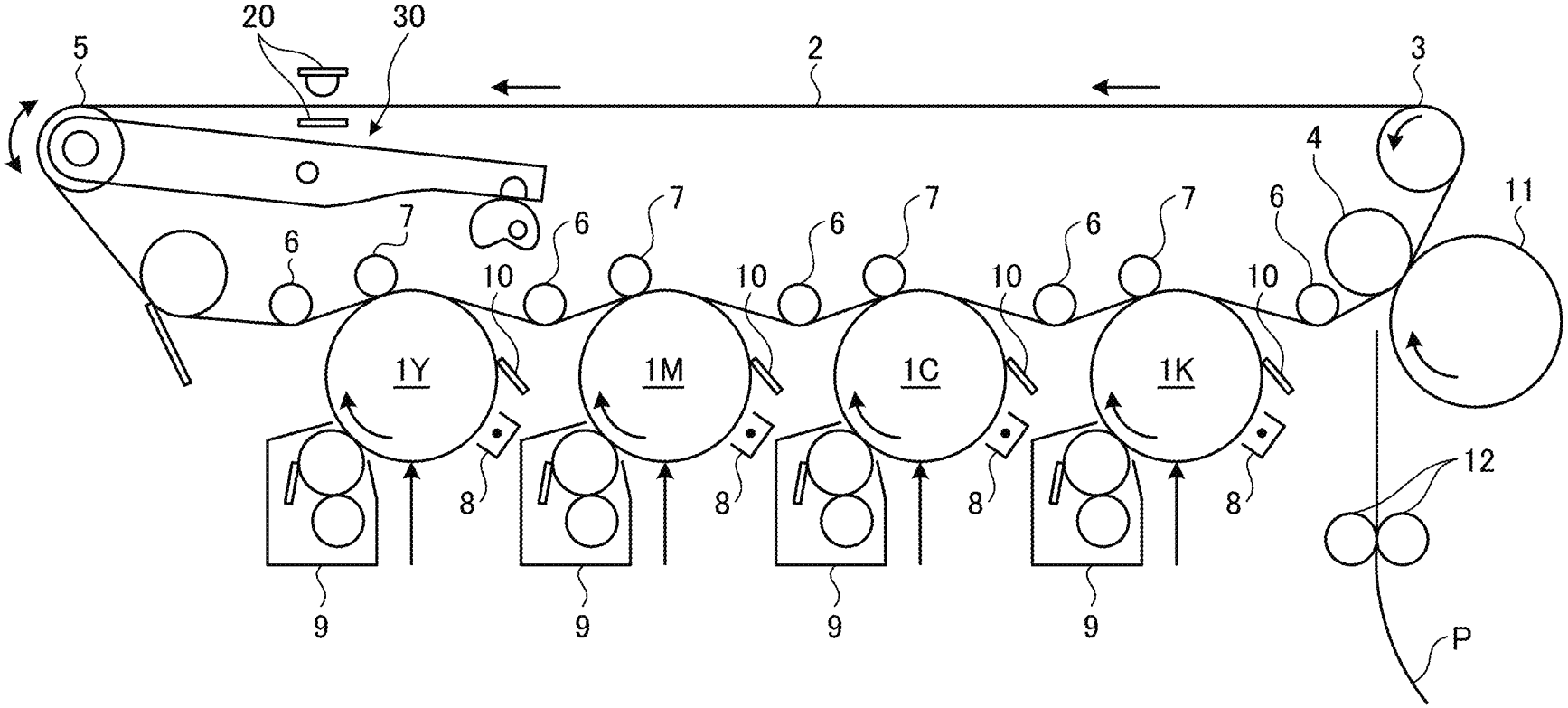
FIG. 2 is a diagram illustrating an example of an electrophotographic image forming apparatus disposed in the printing system of FIG. 1.

As an example, the image forming apparatus 103 may be an electrophotographic wet color image forming apparatus. FIG. 2 is a schematic configuration diagram of the image forming apparatus 103. As illustrated in FIG. 2, the image forming apparatus 103 is provided with a plurality of photoconductors 1Y, 1M, 1C, and 1K that form images with different printing colors. An intermediate transfer belt 2 is wound around a belt driving roller 3, a counter roller 4, an adjustment roller 5, and a plurality of idler rollers 6 in a stretched state, and is in contact with the outer peripheries of photoconductors 1Y, 1M, 1C, and 1K.

The intermediate transfer belt 2 is an example of an endless belt, and is formed of, for example, resin such as polyimide or polyvinylidene fluoride (PVDF), or rubber such as polyurethane. Transfer rollers 7 as primary transfer devices are pressed against the photoconductors 1Y, 1M, 1C, and 1K with the intermediate transfer belt 2 interposed therebetween. Non-contact transfer chargers may be used as the primary transfer devices.

The photoconductors 1Y, 1M, 1C, and 1K are provided with exposure devices. The exposure devices have semiconductor lasers emit optical signals corresponding to image data having been subjected to color separation by a scanner or the like, and scan the photoconductors 1Y, 1M, 1C, and 1K with the laser light by rotationally driven polygon mirrors. In each scanning optical path, disposed are lenses for convergence and correction of optical face tangle error in the polygon mirror, a mirror for deflecting the laser light, and the like.

Each of the photoconductors 1Y, 1M, 1C, and 1K has a charger 8, a developing unit 9 as a developing device, and a cleaning member 10 disposed on the outer periphery thereof. A secondary transfer roller 11 is pressed against the counter roller 4 on which the intermediate transfer belt 2 is stretched. In the lower part of the apparatus body, provided are a sheet tray that stores transfer paper P as transfer material, a feed roller that draws out the transfer paper P one by one from the sheet tray, and a registration roller pair 12 that delivers the transfer paper P guided to the a conveying path to a secondary transfer roller 11.

Above the belt driving roller 3, a fixing roller and a press roller are rotatably provided in contact with each other, and an output roller pair that outputs the transfer paper P having passed through the fixing roller to an output tray is provided.

In the image forming apparatus 103 having such a configuration, images having different printing colors are formed on the photoconductors 1Y, 1M, 1C, and 1K.

Hereinafter, an image forming process on the photoconductor 1Y located on the left will be described. The image forming processes on the other photoconductors 1M, 1C, and 1K are similar in principle to the photoconductor 1Y, and thus the description thereof will be omitted.

First, the photoconductor 1Y is uniformly charged by the electric charge from the charger 8 during rotation. The exposure device is driven on the basis of the image data having been subjected to color separation into a first printing color. Accordingly, an electrostatic latent image as a latent image is formed on the charged portion of the photoconductor 1Y. The electrostatic latent image is developed by the developing unit 9 in the developing device to a toner image. Toner images of corresponding printing colors are sequentially formed on the other photoconductors 1M, 1C, and 1K. Then, for example, the toner images of respective colors of yellow, magenta, cyan, and black are superimposed and primarily transferred onto the intermediate transfer belt 2 by the respective transfer rollers 7.

On the other hand, the transfer paper P drawn out by the feed roller is kept in a standby state with its leading end in contact with the nip portion of the registration roller pair 12. The transfer paper P is conveyed to a secondary transfer position between the secondary transfer roller 11 and the counter roller 4 by the registration roller pair 12 that rotates in synchronization with the rotational movement of the photoconductors 1Y, 1M. 1C, and 1K, so that the toner images on the intermediate transfer belt 2 are secondarily transferred together.

In this manner, the transfer paper P on which the toner images of the respective colors are superimposed and collectively transferred is separated from the intermediate transfer belt 2, the transfer images are fixed in the process of being conveyed by the fixing roller and the press roller, and the transfer paper P is output to the output tray by the output roller pair. Every time the primary transfer is performed, the residual toner adhering to the photoconductors 1Y, 1M, 1C, and 1K is removed by the cleaning members 10 including blades.

The image forming apparatus 103 superimposes and transfers the images of the four colors on the intermediate transfer belt 2. Thus, when deviation or meandering of the intermediate transfer belt 2 occurs, a color shift is generated in the toner images of the four colors primarily transferred onto the intermediate transfer belt 2, which causes a disadvantage that the quality of the toner images is deteriorated.

Therefore, in the image forming apparatus 103 provided in the printing system of the embodiment, as illustrated in FIG. 2, an inclination adjuster 30 including a belt position detection sensor 20 and the adjustment roller 5 is provided in order to prevent deterioration in the image quality due to deviation or meandering of the intermediate transfer belt 2. Hereinafter, the adjustment roller 5, the inclination adjuster 30, and the belt position detection sensor 20 will be described.

Figure 3:
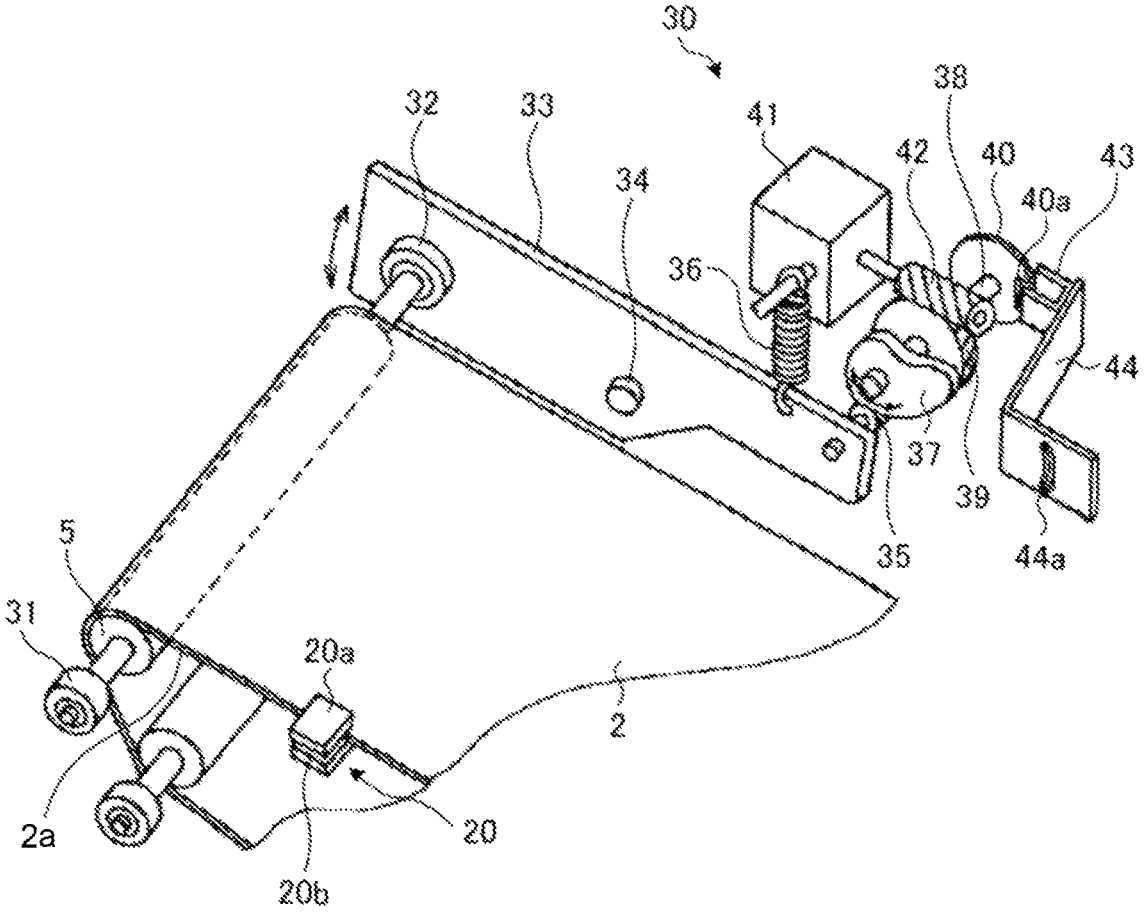
FIG. 3 is a perspective view of an adjustment roller for controlling a deviation of an intermediate transfer belt and a cam for adjusting an inclination of the adjustment roller in the image forming apparatus of FIG. 2.

FIG. 3 is a schematic perspective view of a configuration of the adjustment roller 5 for controlling the deviation of the intermediate transfer belt 2 and the inclination adjuster 30 for adjusting the inclination of the adjustment roller 5. Referring to FIG. 3, the adjustment roller 5 is rotatably supported by a bearing 31 and a bearing 32. The bearing 31 serving as a fulcrum of the oscillation of the adjustment roller 5 is supported by and fixed to a side plate of a belt unit in which the intermediate transfer belt 2 is disposed.

On the other hand, the bearing 32 on the oscillation side of the adjustment roller 5 is supported by an oscillation lever 33. The oscillation lever 33 rotates about a fulcrum shaft 34. A cam follower 35 is provided at a free end of the oscillation lever 33. The free end of the oscillation lever 33 is pulled upward by a spring 36. Accordingly, the cam follower 35 is in contact with a cam 37 provided above.

The cam 37 is fixed to a camshaft 38, and a worm wheel 39 and a filler 40 are secured coaxially with the camshaft 38. A worm gear 42 is fixed to the shaft of a cam motor 41 and is meshed with the worm wheel 39. The cam motor 41 includes a stepping motor. A slit 40*a* is formed in the filler 40, and a photosensor 43 is disposed so as to detect the slit 40*a*. The photosensor 43 is fixed to a sensor mount 44. The sensor mount 44 is provided with a long hole 44*a* for securing with a screw or the like. The long hole 44*a* has a shape corresponding to the curvature of the outer periphery of the filler 40. By changing the securing position of the long hole 44*a*, the position of the photosensor 43 can also be changed along the outer periphery of the filler 40.

Figure 4:
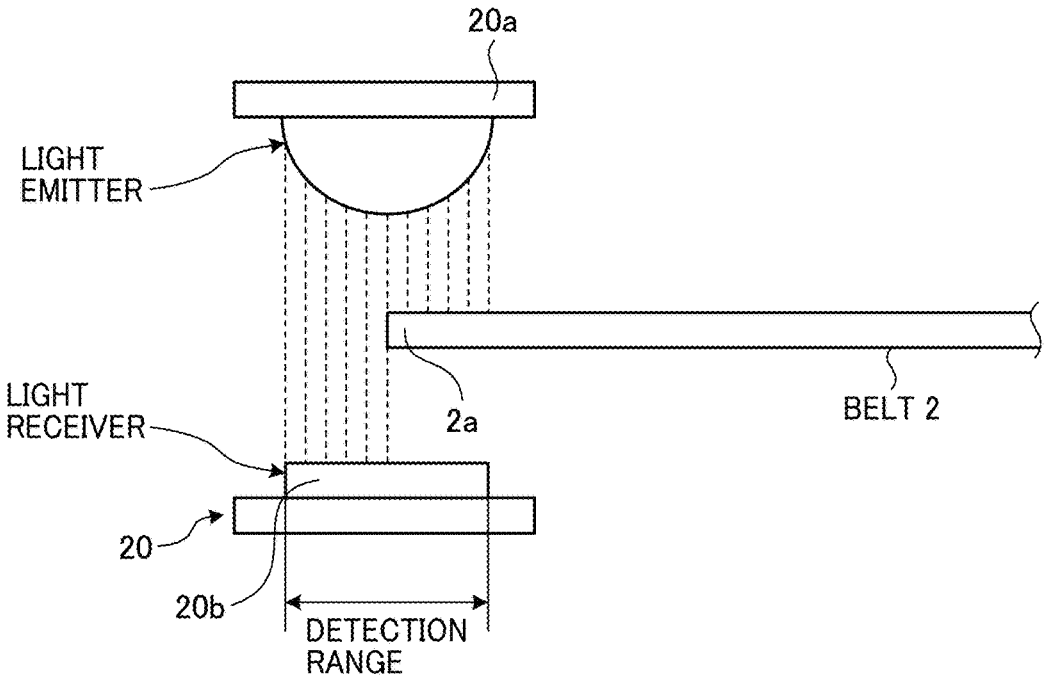
FIG. 4 is a diagram illustrating a belt position detection sensor that detects the position of the intermediate transfer belt.

The belt position detection sensor 20 is an example of a belt position detector, and is provided on a fulcrum side opposite to the side oscillating by the oscillation mechanism of the adjustment roller 5 described above. As illustrated in FIG. 4, a light emitter 20*a* and a light receiver 20*b* are disposed with a belt edge 2*a* of the intermediate transfer belt 2 interposed therebetween. The positional relationship between the light emitter 20*a* and the light receiver 20*b* may be the inverse of the illustrated positional relationship. As illustrated in FIG. 4, the belt position detection sensor 20 includes the light emitter 20*a* including a light emitting diode (LED) and the like, and the light receiver 20*b* including a photodiode and the like. The light emitter 20*a* and the light receiver 20*b* are provided with the belt edge 2*a* of the intermediate transfer belt 2 interposed therewith.

The light receiver 20*b* of the belt position detection sensor 20 generates a voltage upon reception of light from the light emitter 20*a*, and the detected voltage varies depending on the amount of light received from the light emitter 20*a*. Therefore, referring to FIG. 4, if the position of the belt edge 2*a* of the intermediate transfer belt 2 is shifted to the left or right, the amount of light emitted from the light emitter 20*a* of the belt position detection sensor 20 to the light receiver 20*b* changes, and as illustrated in FIG. 4, the detected voltage of the light receiver 20*b* also changes.

For example, when the light from the light emitter 20*a* is all blocked by the belt edge 2*a* of the intermediate transfer belt 2, the detected voltage of the light receiver 20*b* becomes 0 V. When all the light from the light emitter 20*a* is transmitted, the detected voltage of the light receiver 20*b* becomes maximum (for example, 5 V). Here, the center value from 0 to the maximum of the detected voltage of the light receiver 20*b* is set as the reference position of the intermediate transfer belt 2.

Accordingly, the position of the intermediate transfer belt 2 can be determined by detecting the detected voltage of the light receiver 20*b* of the belt position detection sensor 20 when the intermediate transfer belt 2 meanders. On the other hand, the position of the cam 37 that oscillates the adjustment roller 5 also changes the inclination of the adjustment roller 5 up and down according to the rotation direction of the cam 37 with the position where the adjustment roller 5 is parallel to the other belt driving roller 3 and the like as a reference position.

Figure 5:
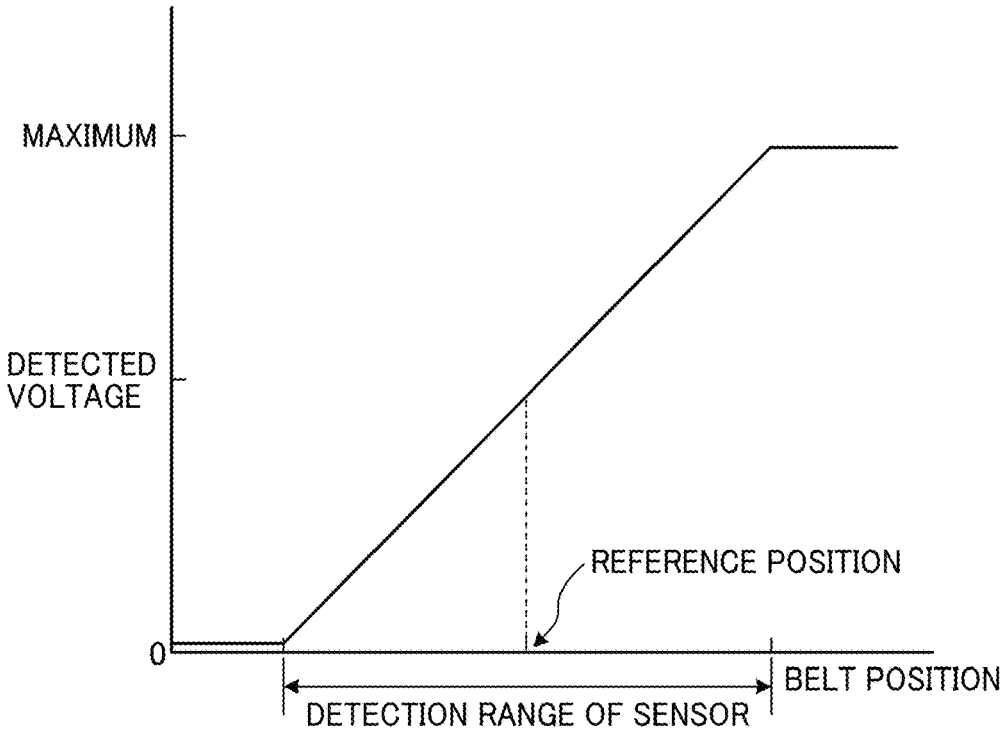
FIG. 5 is a graph illustrating a relationship between the position of the intermediate transfer belt and a detected voltage of the belt position detection sensor.

Next, description will be provided as to an operation of controlling the deviation of the intermediate transfer belt 2 by detecting the position of the belt edge 2*a* of the intermediate transfer belt 2 using the belt position detection sensor 20. First, the cam 37 is in contact with the cam follower 35 at a reference position of the angle 0 as illustrated in FIG. 5. In this state, the adjustment roller 5 is in a substantially horizontal position.

Here, if the intermediate transfer belt 2 meanders and rotates to move the position of the belt edge 2*a*, the belt position detection sensor 20 detects the position of the intermediate transfer belt 2. Then, the cam 37 is rotated by the cam motor 41 on the basis of the detection result. By the rotation of the cam 37, the oscillation lever 33 is oscillated with the fulcrum shaft 34 as an oscillation center. Accordingly, the adjustment roller 5 becomes inclined, and the intermediate transfer belt 2 is moved in the direction opposite to the direction deviated by the meandering thereof.

Figure 6:
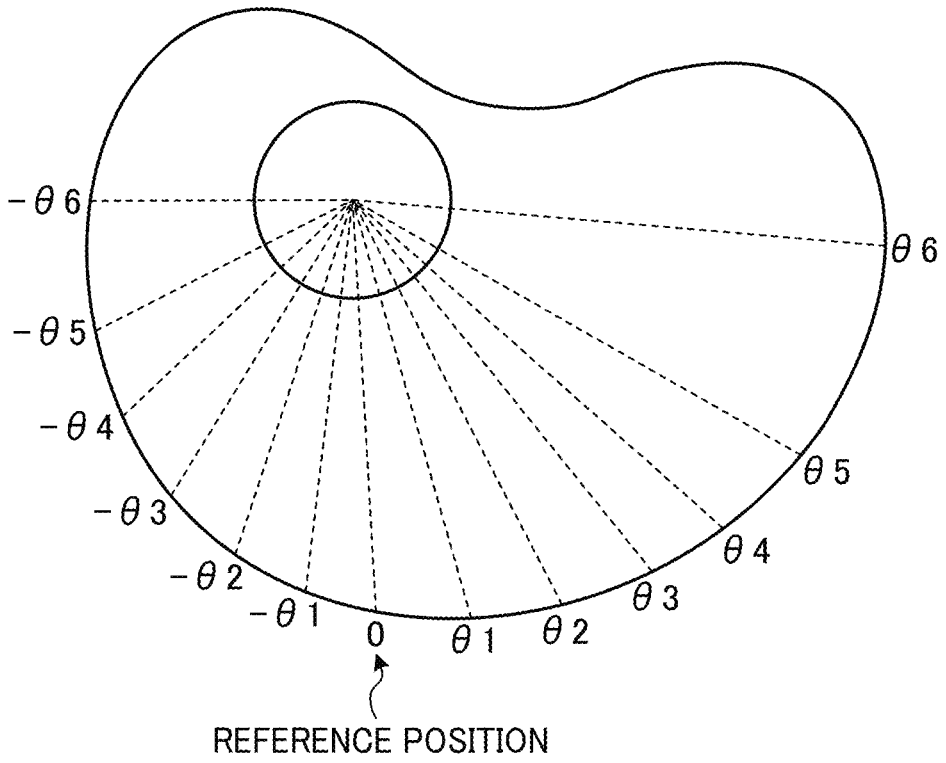
FIG. 6 is a diagram illustrating details of the cam for adjusting an inclination of the adjustment roller.

Specifically, as illustrated in FIG. 6, as the position of the intermediate transfer belt 2 approaches 0.5, 1.0, 1.5, and 2.0 from the reference position, the inclination amount of the adjustment roller 5 is also increased to 0.1, 0.2, 0.3, and 0.4. This changes the position of the intermediate transfer belt 2 in proportion to the inclination amount of the adjustment roller 5. At this time, the rotation amount of the cam 37 is increased to θ1, θ2, θ3, and θ4. Thus, even if the condition of the load applied to the intermediate transfer belt 2 is changed and the position of the intermediate transfer belt 2 is deviated from the reference position, the intermediate transfer belt 2 is inclined while being finely adjusted up and down by the adjustment roller 5 according to its inclination state, so that the deviation of the position of the intermediate transfer belt 2 is corrected.

In the image forming apparatus 103, the inclination amount of the adjustment roller 5 is managed in association with the number of steps of the stepping motor (cam motor 41) proportional to the rotation amount of the cam 37. Here, an actual relationship between the belt deviation of the intermediate transfer belt 2 and the inclination of the adjustment roller 5 is as follows.

That is, when the intermediate transfer belt 2 becomes shifted leftward in the conveyance direction, the oscillating side of the adjustment roller 5 is gradually inclined upward. This stops the shift of the intermediate transfer belt 2 but the intermediate transfer belt 2 then starts to shift rightward. When the intermediate transfer belt 2 starts to shift rightward, the adjustment roller 5 is gradually inclined downward from the position having been inclined so far. This repetition converges the deviation amount of the intermediate transfer belt 2 and the inclination amount of the adjustment roller 5 into small amounts.

If the first deviation direction of the intermediate transfer belt 2 is rightward in the conveyance direction, the direction in which the adjustment roller 5 is inclined is downward. That is, regarding the signs (+ and −) in FIG. 6, the positions of the intermediate transfer belt 2 shifted leftward are denoted with (+) and the positions of the intermediate transfer belt 2 shifted rightward are denoted with (−) with respect to the reference position, and the upward inclinations of the adjustment roller 5 are denoted with (+) and the downward inclinations of the adjustment roller 5 are denoted with (−) with respect to the reference position. The reference position of the intermediate transfer belt 2 is determined by detecting the position of the slit 40*a* in the filler 40 with the photosensor 43 and determining the rotational position of the cam 37.

Meanwhile, the inclination of the adjustment roller 5 at which the intermediate transfer belt 2 hardly shifts has individual differences due to unit or belt replacement, or the like. Therefore, the reference position of the intermediate transfer belt 2 is changed by changing the fixing position of the photosensor 43 in accordance with the intermediate transfer belt 2 and the unit. This makes it possible to reduce the deviation of the intermediate transfer belt 2 and the shift amount of inclination of the adjustment roller 5, and shorten the time until the deviation of the intermediate transfer belt 2 is suppressed.

If the belt edge 2*a* of the intermediate transfer belt 2 goes out of the detection range of the belt position detection sensor 20 due to variation of some load applied to the intermediate transfer belt 2, the point of contact of the cam 37 illustrated in FIG. 6 with the cam follower 35 is set to θ6 or θ6, so as to be larger than the change amount of the detection range. Accordingly, even in an abnormal state where the intermediate transfer belt 2 is excessively shifted, the intermediate transfer belt 2 can be quickly returned to the detection range.

Figure 7:
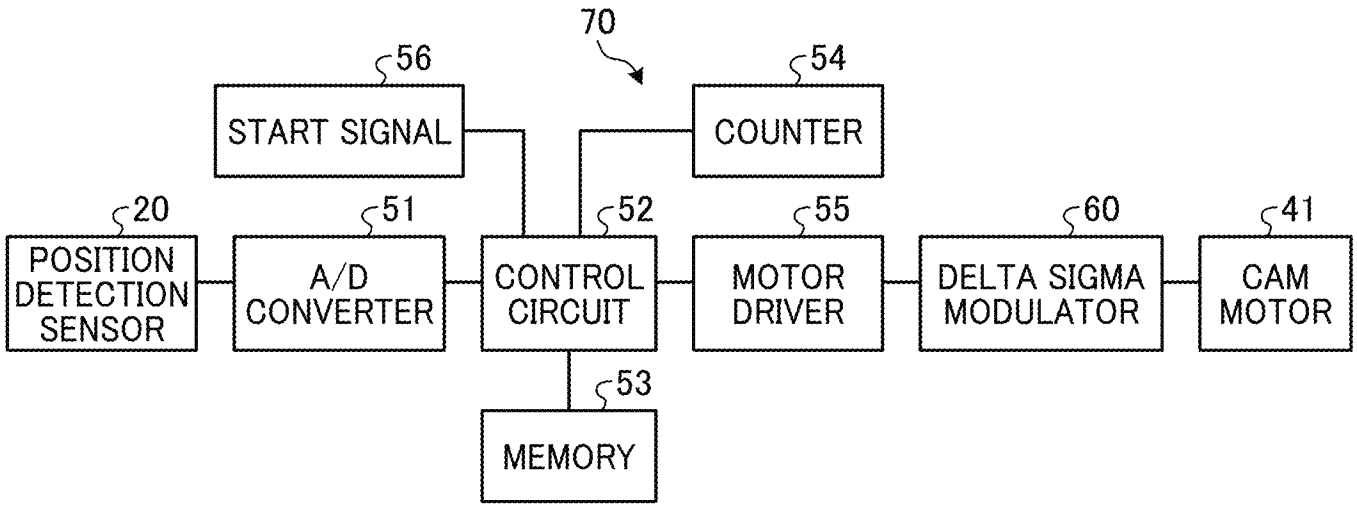
FIG. 7 is a block diagram illustrating a configuration of a belt deviation controller for controlling the position of the intermediate transfer belt.

FIG. 7 is a block diagram of a belt deviation controller 70 for controlling the position of the intermediate transfer belt 2. As illustrated in FIG. 7, the belt deviation controller 70 includes an A/D converter 51, a control circuit 52, a memory 53, a counter 54, and a motor driver 55. The belt deviation controller 70 also includes a delta sigma modulator 60 (an example of a control output adjuster) to be described later.

In FIG. 7, first, the belt deviation controller 70 converts the analog signal output by the belt position detection sensor 20 into a digital signal by the A/D converter 51, and sends the digital signal to the control circuit 52. The belt deviation controller 70 compares the belt position data and data on the rotation speed and direction of the cam motor 41 with respect to the belt position stored in advance in the memory 53, and gives appropriate rotation to the cam motor 41 by a motor driver 55. The belt deviation controller 70 repeatedly executes these steps to perform belt deviation control.

As another method, in FIG. 7, the control circuit 52 receives a start signal 56 of the image forming apparatus 103, and the counter 54 counts the time from the start. The count time is compared with the time stored in the memory 53, the belt deviation control operation is performed until the time, and then the image forming operation is performed.

As still another method, the time for one cycle of the intermediate transfer belt 2 is stored in the memory 53, and compared with the time counted by the counter 54. When the time corresponding to one cycle of the intermediate transfer belt 2 is reached, the cam motor 41 is rotated based on output data from the belt position detection sensor 20 to perform belt deviation control. This makes it possible to perform the belt deviation control for each cycle of the intermediate transfer belt 2, and remove the straightness and the error of the belt edge 2*a* of the intermediate transfer belt 2.

Improvement in Resolution of Driving Step of Stepping Motor

Since the minimum driving step of rotationally controlling the cam motor (stepping motor) 41 with the belt deviation controller 70 illustrated in FIG. 7 is one driving step, the control resolution becomes coarse, and there is a possibility that a position variation of the intermediate transfer belt 2 occurs even in a normal state.

Specifically, FIGS. 8A to 8C illustrate position variation and deviation speed of the intermediate transfer belt 2, and the number of control steps of the cam motor 41. FIG. 8A illustrates positions of the intermediate transfer belt 2 as seen in a direction (width direction of the intermediate transfer belt 2) orthogonal to the conveyance direction of the intermediate transfer belt 2. The position "0" is an ideal position where no deviation occurs in the intermediate transfer belt 2. Since the minimum driving step of rotationally controlling the cam motor 41 is one driving step, the belt deviation control of the intermediate transfer belt 2 becomes rough, and the position of the intermediate transfer belt 2 varies with the position where the deviation amount is "0" as a boundary. The upper and lower amplitudes with the position "0" in FIG. 8A as a boundary indicate the transition of the position of the intermediate transfer belt 2 caused by controlling the cam motor 41 by one driving step.

FIG. 8B illustrates differential values of the positions of the intermediate transfer belt 2 illustrated in FIG. 8A, and illustrates the moving speed (deviation speed) of the intermediate transfer belt 2. Referring to FIG. 8B, the deviation speed becomes "0" at a position where the deviation amount of the intermediate transfer belt 2 becomes "0". However, performing the belt deviation control of the intermediate transfer belt 2 by one driving step as described above increases the change in the deviation speed with "0" as a boundary.

FIG. 8C illustrates the number of control steps of the cam motor 41. The value "0" at the center indicates a 0 driving step, which indicates a state in which the cam motor 41 is not rotated. With the 0 driving step as a boundary, steps in the positive direction such as "+1" and "+2" indicate driving steps of rotationally driving the cam motor 41 in the normal direction. Steps in the negative direction such as "−1" indicate driving steps of rotationally driving the cam motor 41 in a direction opposite to the normal direction. As illustrated in FIG. 8C, when the cam motor 41 is rotationally controlled by one driving step, there is a disadvantage that the position of the intermediate transfer belt 2 fluctuates from start to finish with the position where the deviation amount is "0" as a boundary as illustrated in FIG. 8A.

For this reason, in the printing system of the embodiment, in order to obtain a rotation angle in less than one step of the cam motor 41, the control output is supplied to the cam motor 41 for the time corresponding to a rotation angle less than the rotation angle in one step, out of the supply time of the control output for obtaining the rotation angle in one step, and the control output is not supplied for the remaining time. The cam motor 41 rotates while being supplied with the control output. Therefore, dividing the supply time of the control output for one step into the "supply time" and the "non-supply time" according to the rotation angle in less than one step to be obtained makes it possible to rotationally control the cam motor 41 at the rotation angle in less than one step.

Configuration and Operation of Delta Sigma Modulator

As an example, such control of the rotation angle of the cam motor 41 can be performed by delta sigma modulation processing. That is, in the printing system of the embodiment, as illustrated in FIG. 7, the delta sigma modulator 60 is provided in the belt deviation controller 70 of the image forming apparatus 103. The delta sigma modulator 60 converts the rotation angle into an integer by delta sigma modulation processing, and the cam motor 41 is driven on the basis of the value.

FIG. 9 is a circuit diagram of the delta sigma modulator 60. As illustrated in FIG. 9, the delta sigma modulator 60 includes an adder 71, an integrator 72, a comparator (hysteresis comparator) 73, and a 1-bit digital-analog converter (1-bit DAC) 74.

The adder 71 includes a first input terminal (+) and a second input terminal (−). The output of the motor driver 55 is supplied to the first input terminal (+). Furthermore, the output of the 1-bit DAC 74 is negatively fed back and supplied to the second input terminal (−).

An output terminal of the adder 71 is connected to an input terminal of the integrator 72. An output terminal of the integrator 72 is connected to an input terminal of the comparator 73. The output of the comparator 73 is supplied to the cam motor 41 and also supplied to the 1-bit DAC 74. The 1-bit DAC 74 analogizes the output of the comparator 73 and negatively feeds the output back to the second input terminal (−) of the adder 71.

In the delta sigma modulator 60, the control output (analog value) of the rotation angle of the cam motor 41 output from the control circuit 52 via the motor driver 55 is integrated by the integrator 72, binarized by the comparator 73 when the value becomes "I", and supplied to the cam motor 41. The output from the comparator 73 is converted into an analog form by the 1-bit DAC 74 and negatively fed back to the second input terminal (−) of the adder 71. The integrator 72 performs integration processing on a difference between the control output of the step angle output from the control circuit 52 via the motor driver 55 and the output of the comparator 73. The delta sigma modulator 60 repeatedly performs these operations.

Accordingly, instead of rounding the control output of the rotation angle to an integer, the delta sigma modulation processing can be performed on the decimal of the angle to be output, thereby obtaining an output having a target fractional rotation angle in a pseudo manner. Specifically, if the rotation angle is set to 0.25, for example, there has been conventionally no choice but to set the step value to zero step. However, in the printing system of the embodiment, the delta sigma modulator 60 sets ¾ seconds as zero step and the remaining ¼ seconds as one step, so that the cam motor 41 can be rotationally controlled in 0.25 steps. In this example, ¼ seconds may be set as one step, and the remaining ¾ seconds may be set as zero step. This reduces the occurrence of deviation of the intermediate transfer belt 2 in a normal state or the like can be reduced.

FIGS. 10A to 10C are diagrams illustrating a state in which the deviation of the intermediate transfer belt 2 is reduced by the delta sigma modulation processing. In the case of FIGS. 10A to 10C, similarly to FIGS. 8A to 8C, FIG. 10A illustrates the position of the intermediate transfer belt 2 as seen in a direction (width direction of the intermediate transfer belt 2) orthogonal to the conveyance direction of the intermediate transfer belt 2. FIG. 10B illustrates a differential value of the position of the intermediate transfer belt 2 illustrated in FIG. 10A, indicating the moving speed (deviation speed) of the intermediate transfer belt 2. FIG. 10C illustrates the number of control steps of the cam motor 41, and illustrates a state in which the cam motor 41 is rotationally controlled in fine steps that are less than one step.

Since the printing system of the embodiment can control the rotation of the cam motor 41 to a rotation angle less than one step, the deviation of the intermediate transfer belt 2 can be finely controlled to reduce the deviation amount in a normal state or the like as illustrated in FIGS. 10A to 10C.

Advantageous Effects of Embodiment

When the minimum controllable driving step of the stepping motor is one driving step, the rotation control may be discrete and rough. Accordingly, if the stepping motor of the belt deviation controller is rotationally controlled to correct the belt deviation, it may be difficult to correct the belt deviation because the rotation control becomes rough.

As is apparent from the above description, the printing system of the embodiment can produce the following advantageous effects.

1. Even if the reference position of the adjustment roller 5 is shifted from the center position at the time of controlling the actual belt deviation, the inclination of the adjustment roller 5 can be controlled around the shifted position, and the belt deviation can be controlled with high accuracy. This improves image quality.

2. If the intermediate transfer belt 2 is out of the detection range of the position detection sensor 20, the inclination amount of the adjustment roller 5 is made larger than the value in the proportional relationship. This makes it possible to prevent an inconvenience that the intermediate transfer belt 2 is completely shifted and difficult to control, and to quickly return the belt deviation to the control range.

3. The position detection sensor 20 of the intermediate transfer belt 2 is provided on the fulcrum side of the adjustment roller 5. This almost eliminates the inclination of the adjustment roller 5 on the fulcrum side, so that the runout of the intermediate transfer belt 2 can be reduced at the portion where the position detection sensor 20 is provided. Therefore, the position detection sensor 20 can be downsized.

4. Since the inclination of the adjustment roller 5 can be changed and adjusted with the reference position as a boundary, the reference position of the adjustment roller 5 can be easily adjusted when the drive device for the intermediate transfer belt 2 is assembled or the intermediate transfer belt 2 is replaced. Therefore, the detection range of the position of the intermediate transfer belt 2 can be set to a narrow range.

5. The intermediate transfer belt 2 is rotated constantly to adjust the inclination of the adjustment roller 5, the deviation of the intermediate transfer belt 2 is controlled, and then image formation is started. Accordingly, even if the meandering width of the intermediate transfer belt 2 increases, such as immediately after the assembly of the belt driving device of the intermediate transfer belt 2 or immediately after the belt replacement, an image can be formed after the meandering width of the intermediate transfer belt 2 is reduced. This prevents deterioration of image quality.

6. The edge of the intermediate transfer belt 2 is detected by the position detection sensor 20 in the direction orthogonal to the conveyance direction of the intermediate transfer belt 2. Therefore, the deviation of the intermediate transfer belt 2 can be detected without providing a detection mark on the intermediate transfer belt 2.

7. The position of the intermediate transfer belt 2 is detected at the same position in the moving direction at each rotation of the intermediate transfer belt 2, and the belt deviation control is performed based on the detection result. This eliminates the straightness error of the belt edge shape, so that the deviation control of the intermediate transfer belt 2 can be accurately performed.

8. As an example, using delta sigma modulation processing, the control output is supplied to the cam motor 41 for the time corresponding to a rotation angle less than the rotation angle in one step, out of the supply time of the control output for obtaining the rotation angle in one step, and the control output is not supplied for the remaining time. Accordingly, a rotation angle of the cam motor 41 less than the rotation angle in one step can be obtained, and rotational control of the cam motor 41 can be finely performed. Therefore, the deviation of the intermediate transfer belt 2 at a normal time or the like can be finely adjusted to further improve the image quality.

Modifications

In the above description of the embodiment, the image forming apparatus 103 is an electrophotographic wet color image forming apparatus, but an inkjet image forming apparatus illustrated in FIG. 11 may be used instead. An inkjet image forming apparatus 103 illustrated in FIG. 11 includes a sheet feeder 501, an image former 506, a dryer 502, and a sheet ejector 503.

In the image forming apparatus 103, the image former 506 forms an image on paper sheet P, which is a recording material as a sheet material fed from the sheet feeder 501, by ink, which is a liquid for image formation. Then, the dryer 502 dries the ink adhered to the sheet, and then the sheet ejector 503 ejects the sheet.

Sheet Feeder

The sheet feeder 501 includes a sheet feeding tray 511 on which a plurality of paper sheets P is stacked, a feeding device 512 that separates and feeds the paper sheets P one by one from the sheet feeding tray 511, and a pair of registration rollers 513 that feeds the paper sheets P to the image former 506.

The feeding device 512 may be any feeding device such as a device using rollers and rolls or a device using air suction. After the leading end of the sheet fed from the sheet feeding tray 511 by the feeding device 512 reaches the pair of registration rollers 513, the pair of registration rollers 513 is driven at a predetermined timing to feed the sheet to the image former 506. There is no limitation on the configuration of the sheet feeder 501 as long as the sheet feeder 501 feeds the paper sheet P to the image former 506.

Image Former

The image former 506 includes a receiving cylinder 561 that receives the fed paper sheet P, a sheet bearing drum 562 that bears, on an outer peripheral surface, the paper sheet P conveyed by the receiving cylinder 561 and conveys the paper sheet P, an ink discharger 564 that discharges ink toward the paper sheet P borne by the sheet bearing drum 562, and a delivery cylinder 565 that delivers, to the dryer 502, the paper sheet P conveyed by the sheet bearing drum 562.

The leading end of the paper sheet P conveyed from the sheet feeder 501 to the image former 506 is gripped by a sheet gripper provided on the surface of the receiving cylinder 561, and the paper sheet P is conveyed along with the surface movement of the receiving cylinder 561. The paper sheet P conveyed by the receiving cylinder 561 is delivered to the sheet bearing drum 562 at a position facing the sheet bearing drum 562.

A sheet gripper is also provided on the surface of the sheet bearing drum 562, and the leading end of the sheet is gripped by the sheet gripper. In addition, a plurality of suction holes is dispersedly formed in the surface of the sheet bearing drum 562, and a suction airflow toward the inside of the sheet bearing drum 562 is generated in each of the suction holes by a suction device 563. The leading end of the paper sheet P delivered from the receiving cylinder 561 to the sheet bearing drum 562 is gripped by the sheet gripper, is attached to the surface of the sheet bearing drum 562 by the suction airflows, and is conveyed along with the surface movement of the sheet bearing drum 562.

The ink discharger 564 discharges inks of four colors C (cyan), M (magenta), Y (yellow), and K (black) to form an image, and includes individual liquid discharge heads 564C, 64M, 564Y, and 564K for the corresponding inks. There is no limitation on the configuration of the liquid discharge heads 564C, 64M, 564Y, and 564K as long as they discharge liquids, and any configuration can be adopted. As required, another liquid discharge head that discharges ink of a special color such as white, gold or silver may be provided or another liquid discharge head that discharges a liquid not forming an image, such as a surface coating liquid, may be provided.

The discharge operations of the liquid discharge heads 564C, 564M, 564Y, 564K of the ink discharger 564 are controlled by driving signals corresponding to image data. While the paper sheet P borne on the sheet bearing drum 562 passes through the area facing the ink discharger 564, the respective color inks are discharged from the liquid discharge heads 564C, 564M, 564Y, and 564K, and an image corresponding to the image data is formed on the paper sheet P. There is no limitation on the configuration of the image former 506 as long as the image former attaches a liquid onto the paper sheet P to form an image.

Dryer

The dryer 502 includes a drying mechanism 521 for drying the ink attached on the paper sheet P in the image former 506, and a conveyance mechanism 522 for conveying the paper sheet P conveyed from the image former 506. The paper sheet P conveyed from the image former 506 is received by the conveyance mechanism 522, conveyed so as to pass through the drying mechanism 521, and delivered to the sheet ejector 503. At the time of passing through the drying mechanism 521, the ink on the paper sheet P is subjected to a drying process, whereby liquid components such as moisture in the ink evaporate, and the ink adheres to the paper sheet P and the paper sheet P is suppressed from curling.

Sheet Ejector

The sheet ejector 503 includes an output tray 531 on which a plurality of paper sheets P is stacked. The paper sheets P conveyed from the dryer 502 are sequentially stacked and held in the output tray 531. There is no limitation on the configuration of the sheet ejector 503 as long as it ejects the paper sheets P.

Other Functional Units

The image forming apparatus 103 includes the sheet feeder 501, the image former 506, the dryer 502, and the sheet ejector 503. However, other functional units may be appropriately added. For example, a pre-processing device that performs pre-processing of image formation may be added between the sheet feeder 501 and the image former 506. In addition, a post-processing device that performs post-processing of image formation may be added between the dryer 502 and the sheet ejector 503.

An example of the pre-processing device performs a processing liquid applying operation to apply a processing liquid onto the paper sheet P so as to reduce ink bleeding by reaction with ink. However, the content of the pre-processing operation is not particularly limited. Examples of the post-processing device include a sheet reverse conveyance process of reversing a paper sheet P on which an image has been formed by the image former 506 and conveying the paper sheet P to the image former 506 again to form an image on both sides of the paper sheet P, a process of binding a plurality of paper sheets P on which an image is formed, a correction mechanism that corrects sheet deformation, or a cooling mechanism that cools the paper sheet P. However, the content of the post-processing is not particularly limited.

Even when such an inkjet image forming apparatus 103 is used, the same effects as those of the above-described embodiments can be obtained.

Finally, the above-described embodiments are presented as examples and are not intended to limit the scope of the present disclosure. The above-described embodiments can be implemented in various other forms, and various omissions, substitutions, and changes can be made without departing from the gist of the present disclosure.

For example, the material of the "sheet" is not limited to paper, and may be any material as long as the material includes an overhead projector (OHP) film (polyester film), cloth, glass, substrate, or the like, and ink droplets, other liquids, and the like can adhere to the material. In addition, the "sheet" includes what is referred to as recording medium, recording paper, recording sheet, or the like. The terms "image formation", "recording", "printing", and "image printing" are used herein as synonyms.

The "inkjet printer apparatus" may form an image by discharging a liquid onto a medium such as paper, thread, fiber, cloth, leather, metal, plastic, glass, wood, or ceramics. The "image formation" includes not only forming an image such as text or graphics on a medium but also forming an image having no meaning such as a pattern on a medium (simply landing a liquid (droplets) on a medium).

Unless otherwise specified, the term "ink" is not limited to what is referred to as ink and is used as a generic term for all liquids capable of forming an image as well as a recording liquid, a fixing treatment liquid, a liquid, and the like. For example, the "ink" includes a deoxyribonucleic acid (DNA) specimen, a resist, a pattern material, a resin, and an aqueous latex ink for sine graphics.

The "image" is not limited to a planar one, and includes a three-dimensional image or a three-dimensional fabricated article.

The present disclosure can be applied to a single-function machine such as a printer apparatus, a facsimile machine, or a copier, or a multifunction peripheral.

As the liquid discharge apparatus, not only an apparatus capable of discharging a liquid to an object to which a liquid can adhere but also an apparatus that discharges a liquid toward a gas or liquid may be used.

The "liquid discharge apparatus" may include a unit related to feeding, conveying, and ejecting a material to which a liquid can adhere, a pre-processing apparatus, a post-processing apparatus, and the like.

The "liquid discharge apparatus" is not limited to an apparatus to discharge a liquid to visualize meaningful images, such as letters or figures. For example, the "printing apparatus" may include an apparatus to form meaningless images, such as meaningless patterns.

The "object to which a liquid can adhere" means an object to which a liquid can at least temporarily adhere, an object to which a liquid adheres and is fixed, an object to which a liquid adheres and permeates, or the like. Specific examples of the "object to which a liquid can adhere" include recording media (e.g, paper, recording paper, recording sheets, films, and cloth), electronic components (e.g. electronic substrates and piezoelectric elements), and media (e.g. particle layers (powder layers), organ models, and inspection cells), and include all those to which a liquid adheres unless otherwise specified.

The "object to which a liquid can adhere" may include any materials on which a liquid can adhere even temporarily, such as paper, thread, fiber, cloth, leather, metal, plastic, glass, wood, and ceramics.

Further, the term "liquid" includes any liquid having a viscosity or a surface tension that is dischargeable from the head. However, preferably, the viscosity of the liquid is not greater than 30 mPa-s under ordinary temperature and ordinary pressure or by heating or cooling. More specific examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. The above-described examples can be used, for example, for inkjet inks, surface treatment liquids, liquids for forming constituent elements of electronic elements and light-emitting elements, and resist patterns of electronic circuits.

The "liquid discharge apparatus" may be an apparatus to relatively move the liquid discharge head and a material on which liquid can adhere. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet surface to coat the treatment liquid on the sheet surface to reform the sheet surface and an injection granulation apparatus in which a composition liquid including raw materials dispersed in a solution is injected through nozzles to granulate fine particles of the raw materials.

The "liquid discharge head 564" is not limited in terms of the pressure generator to be used. For example, in addition to the piezoelectric actuator (which may use a laminated piezoelectric element), a thermal actuator using an electrothermal transducer such as a heating resistor, an electrostatic actuator including a diaphragm and a counter electrode, or the like may be used.

The terms "image formation", "recording", "printing", "image printing", and "fabricating" used herein may be used synonymously with each other.

The "liquid discharge head 564" is housed in the "liquid discharge device". The liquid discharge device is formed by integrating functional components, mechanisms, and the liquid discharge head 564 into a single unit, and is an assembly of components related to liquid discharge. For example, the "liquid discharge device" includes a combination of the liquid discharge head with at least one of a head tank, a carriage, a supply unit, a maintenance unit, and a main scan moving unit.

Examples of the "integration" include a combination in which the liquid discharge head and a functional component (s) or mechanism(s) are secured to each other through. e.g., fastening, bonding, or engaging, and a combination in which one of the liquid discharge head and a functional component (s) or mechanism(s) is movably held by the other. The liquid discharge head and the functional component(s) or mechanism(s) may be detachably attached to each other.

For example, the liquid discharge device may be formed by integrating the liquid discharge head and the head tank. Alternatively, the liquid discharge device may be formed by connecting and integrating the liquid discharge head and the head tank with a tube or the like. A unit including a filter may be added between the head tank and liquid discharge head of the liquid discharge device.

In another example, the liquid discharge device may be formed by integrating the liquid discharge head and the carriage.

In still another example, the liquid discharge device may be formed by movably holding the liquid discharge head by a guide member constituting a part of a scan moving unit, thereby to integrate the liquid discharge head and the scan moving unit. The liquid discharge device may be formed by integrating the liquid discharge head, the carriage, and the main scan moving unit.

In still another example, the liquid discharge device may be formed by securing a cap constituting a part of the maintenance unit to the carriage on which the liquid discharge head is mounted, thereby to integrate the liquid discharge head, the carriage, and the maintenance unit.

Further, in another example, the liquid discharge device may be formed by connecting a tube to the liquid discharge head on which a head tank or a channel part is mounted, thereby to integrate the liquid discharge head and a supply unit. A liquid in a liquid reservoir source is supplied to the liquid discharge head through this tube.

The main scan moving unit may be a single guide member. The supply unit may be a single tube or a single loading unit.

These embodiments and modifications are included in the scope and the gist of the invention and are included in the invention described in the claims and the equivalent scopes thereof.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A belt driving device comprising:

an adjustment roller configured to stretch and rotate an endless belt;

an inclination adjuster including a cam to adjust inclination of the adjustment roller to control deviation of the endless belt;

a belt position detector configured to detect a belt position of the endless belt in a direction orthogonal to a movement direction of the endless belt;

a stepping motor configured to rotate the cam of the inclination adjuster; and a control output adjuster configured to adjust a control output to be supplied to the stepping motor based on the belt position detected by the belt position detector, the control output adjuster configured to, when obtaining a rotation angle less than one step of the stepping motor, supply the control output to the stepping motor for a time corresponding to the rotation angle less than the one step of the stepping motor out of a supply time of the control output for obtaining a rotation angle of the one step of the stepping motor, and stop supplying the control output for a remaining time out of the supply time.

2. The belt driving device according to claim 1, wherein the control output adjuster is configured to adjust the supply time of the control output by delta sigma modulation processing.

3. The belt driving device according to claim 1, wherein the control output adjuster is configured to adjust and control an inclination amount of the adjustment roller in a proportional relationship with respect to a variation amount of the belt position, in a case where the endless belt is within a detection range of the belt position detector; and wherein the control output adjuster is configured to control the inclination amount of the adjustment roller to be larger than a maximum inclination amount in the case where the endless belt is within the detection range, in a case where the endless belt is out of the detection range of the belt position detector.

4. The belt driving device according to claim 3, wherein the inclination adjuster is configured to incline one axial end of the adjustment roller with another axial end of the adjustment roller used as a fulcrum, to adjust the inclination of the adjustment roller, and wherein the belt position detector is disposed on a same side as the fulcrum of the adjustment roller with respect to the endless belt.

5. An image forming apparatus comprising the belt driving device according to claim 1.

6. A belt driving method comprising:

rotating an adjustment roller of a belt driving device to rotate an endless belt of the belt driving device;

adjusting inclination of the adjustment roller to control deviation of the endless belt;

detecting, with a belt position detector, a belt position in a direction orthogonal to a movement direction of the endless belt;

rotating a cam with a stepping motor to adjust the inclination of the adjustment roller;

adjusting a control output to be supplied to the stepping motor, based on the belt position detected by the belt position detector;

to obtain a rotation angle less than one step of the stepping motor, supplying the control output to the stepping motor for a time corresponding to the rotation angle less than the one step of the stepping motor out of a supply time of the control output for obtaining a rotation angle of the one step of the stepping motor; and stopping supply of the control output for a remaining time out of the supply time.

* * * * *